US005704445A

United States Patent [19]

Jones

[11] Patent Number: 5,704,445

[45] Date of Patent: Jan. 6, 1998

[54] METHOD AND APPARATUS FOR DISABLING A MOTOR VEHICLE

[76] Inventor: Daniel Bruce Jones, 21 Leddy Avenue, St. Albert, Alberta, Canada, T8N 1T2

[21] Appl. No.: 610,058

[22] Filed: Feb. 29, 1996

[30] Foreign Application Priority Data

Apr. 26, 1995 [CA] Canada ..... 2147924

[51] Int. Cl.[6] ..... B60R 25/00

[52] U.S. Cl. ..... 180/287; 30/366

[58] Field of Search ..... 180/287; 404/6; 188/32; 256/1; 30/366

[56] References Cited

U.S. PATENT DOCUMENTS

| | | | |
|---|---|---|---|
| 2,912,229 | 11/1959 | Persgard | 256/1 |
| 3,652,059 | 3/1972 | Groblebe | 256/1 |
| 4,382,714 | 5/1983 | Hutchison | 404/6 |
| 4,473,948 | 10/1984 | Chadwick | 30/366 |
| 4,995,756 | 2/1991 | Kilgrow et al. | 404/6 |
| 5,322,385 | 6/1994 | Reisman | 404/6 |
| 5,482,397 | 1/1996 | Soleau | 404/6 |

*Primary Examiner*—Kenneth R. Rice
*Attorney, Agent, or Firm*—Anthony R. Lambert

[57] ABSTRACT

A method of disabling a motor vehicle, comprising the steps of, firstly, providing an apparatus for disabling a motor vehicle which includes a plinth-like base small enough to fit in the palm of a person's hand. The base has a first substantially planar surface and a second substantially planar surface. At least one spike receiving aperture is provided in the first planar surface. At least one hollow tubular spike is removably secured in the at least one spike receiving aperture. The spike protrudes from the first planar surface at an angle of between 55 and 90 degrees. Secondly, positioning the plinth-like base under a tire of a motor vehicle with the at least one spike pointing toward the tire, such that upon the tire rolling over the plinth-like base, the at least one hollow tubular spike is transferred from the base to the tire, puncturing the tire and thereby serving as a conduit for the gradual escape of air to deflate the tire.

9 Claims, 1 Drawing Sheet

METHOD AND APPARATUS FOR DISABLING A MOTOR VEHICLE

FIELD OF THE INVENTION

The present invention relates to a method and apparatus for use by police in disabling a motor vehicle.

BACKGROUND OF THE INVENTION

Every year persons are killed in high speed motor vehicle chases, when police are forced into chasing fleeing suspects. The victims of these high speed chases include police officers, suspects, and members of the public. There are various apparatus that have been developed to bring an early end to these high speed chases. For example, police forces have spike belts that can be laid across a road to disable the tires of a motor vehicle. Police forces do not, however, have any apparatus that can be used to disable a suspect's motor vehicle in advance of police action, thereby rendering a high speed chase unnecessary.

With police stakeouts relating to the theft of stolen property or drug dealings, there is always the possibility that a suspect will be able to get to his motor vehicle before an arrest can be made. However, any overt attempts to disable their motor vehicle may be seen, may activate a car alarm, may leave signs of tampering, or otherwise draw attention to the presence of police. This problem is particularly acute with auto theft. When police find a stolen motor vehicle parked in a parking lot, they must set up a stake out and wait until the thief or thieves come to reclaim the stolen motor vehicle before making an arrest. If there is any sign of police presence, the thieves will simply abandon the stolen vehicle. Once the thieves have identified themselves by entering the motor vehicle, there is a high probability that a police chase will be required to apprehend the suspects.

SUMMARY OF THE INVENTION

What is required is a method and apparatus that can be used to disable a suspect's motor vehicle in advance of police action, thereby rendering a high speed chase unnecessary.

According to one aspect of the present invention there is provided an apparatus for disabling a motor vehicle which includes a plinth-like base small enough to fit in the palm of a person's hand. The base has a first substantially planar surface and a second substantially planar surface. At least one spike receiving aperture is provided in the first planar surface. At least one hollow tubular spike is removably secured in the at least one spike receiving aperture. The spike protrudes from the first planar surface at an angle of between 55 and 90 degrees.

According to another aspect of the present invention there is provided a method of disabling a motor vehicle. An apparatus for disabling a motor vehicle is provided, as described above. The method involves positioning the plinth-like base under a tire of a motor vehicle with the at least one spike pointing toward the tire. Upon the tire rolling over the plinth-like base, the at least one hollow tubular spike is transferred from the base to the tire, puncturing the tire and thereby serving as a conduit for the gradual escape of air to deflate the tire.

The described method has been successfully used by the City of Edmonton Police Force in the Province of Alberta, Canada in association with surveillance involving stolen motor vehicles. A stolen motor vehicle was located in the parking lot of a busy shopping mall. The apparatus was placed under the tire of the motor vehicle in accordance with the teachings of the method. Three adult males were observed getting into the motor vehicle and driving away. The tires of the stolen vehicle rolled over the plinth-like base and were punctured by the protruding spikes. Air slowly escaped from the tires as the suspects drove away. Approximately one block from the shopping mall, the three adult males pulled over to examine the tires of the stolen vehicle. The suspects abandoned the vehicle and were promptly arrested as they walked away by the police surveillance team.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
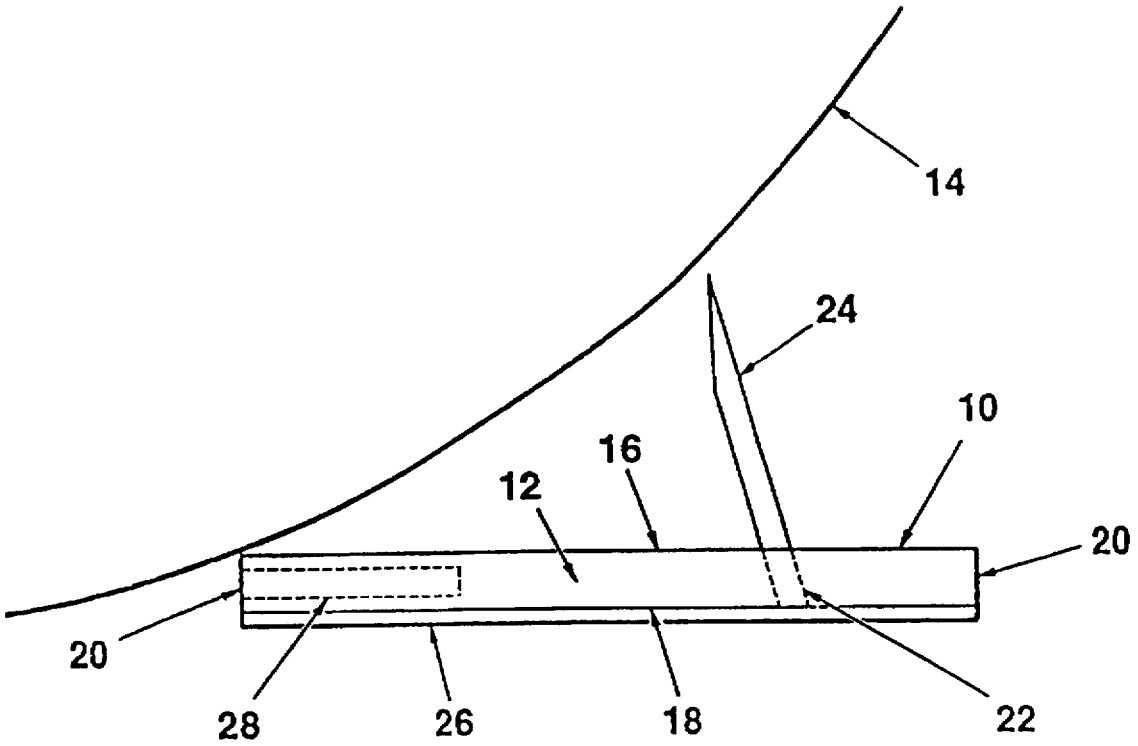
FIG. 1 is a side elevation view of an apparatus for disabling a motor vehicle constructed in accordance with the teachings of the present invention.

The preferred embodiment, an apparatus for disabling a motor vehicle generally identified by reference numeral 10, will now be described with reference to FIGS. 1 and 2.

Figure 2:
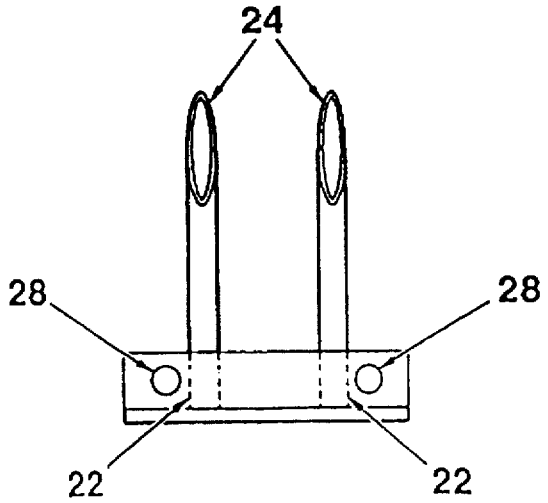
FIG. 2 is an end elevation view of the apparatus for disabling a motor vehicle illustrated in FIG. 1.

Referring to FIG. 1, apparatus 10 includes a plinth-like rubber base 12. It is important that base 12 be small enough to fit in the palm of a person's hand. Too large of a base 12 will be visible when placed under a tire 14. Too large of base 12, will be inconvenient for a policeman to carry on his person. As these situations sometimes arise unexpectedly, it is intended that apparatus 10 be part of standard police equipment that is carried at all times. Base 12 has a first or top substantially planar surface 16, a second or bottom substantially planar surface 18 and a peripheral edge 20. Referring to FIG. 2, two primary spike receiving apertures 22 are provided in first planar surface 16 of base 12. Referring to FIG. 1, spike receiving apertures 22 are angled at an angle of 45 and 85 degrees relative to first planar surface 16. For reasons that will hereinafter be further explained, the preferred range of degrees is between 75 and 85 degrees. An angle of approximately 80 degrees has been illustrated. Two hollow tubular spikes 24 are removably insertable into spike receiving apertures 22. When positioned in spike receiving apertures 22, spikes 24 protrude from first planar surface 16 at an angle of approximately 80 degrees. Metal shielding 26 is provided along second planar surface 18. Metal shielding 26 prevents spikes 24 from being pushed through rubber base 12, when subjected to the weight of tire 14. Referring to FIG. 2, secondary spike receiving apertures 28 are provided along peripheral edge 20 of base 12. Secondary spike receiving apertures 28 provide a place for storage of spikes 24 when they are removed from primary spike receiving apertures 22. It is preferred that plinth-like base 12, metal shielding 26 and spikes 24 are covered by a black coating, thereby camouflaging them so they are less visible adjacent tire 14, which is typically black rubber.

The use and operation of apparatus 10 will now be described in relation to the preferred method. The first step in the method is to provide an apparatus for disabling a motor vehicle resembling apparatus 10, substantially as described above. The second step of the method is to position plinth-like base 12 under tire 14 of a motor vehicle (not shown) with the at least one spike 24 pointing toward tire 14. Upon tire 14 rolling over plinth-like base 12, the hollow tubular spikes 24 are transferred from base 12 to tire 14. Hollow tubular spikes 24 puncture tire 14 serve as a conduit for the gradual escape of air to deflate tire 14. The objective is to disable the motor vehicle rendering it incapable of a high speed chase, before the police surveillance team takes any action to apprehend the suspects.

A broad range of angles between 55 degrees and 90 degrees are workable. It has been found that if the angle is less than 55 degrees, there is a likelihood that spikes 24 will be pushed out of the way instead of puncturing tire 14 as intended. Similarly, it has been found that when spikes 24 are positioned past a 90 degree vertical position, there is a similar likelihood that spikes 24 will be pushed out of the way instead of puncturing tire 14 as intended.

Plinth-like base 12 should be made small enough to avoid detection, and yet large enough that the weight of tire 14 is still rolling over it as spikes 24 are being withdrawn from spike receiving apertures 22. The purpose of this is to ensure that spikes 24 are transferred from base 12 to tire 14. It is undesirable for base 12 to come with spikes 24, as base would block the flow of air through hollow tubular spikes 24. It is preferred that base 12 be made of rubber, or a similar flexible material, in order to avoid bending spikes 24 during the process of transfer from base 12 to tire 14. When a flexible material is used, spike receiving apertures 22 will temporarily deform if pressure is placed upon spikes 24 during the process of transferring from base 12 to tire 14. Spikes 24 are unlikely to be bent and can be pulled from tire 14 with pliers and reused.

It will be apparent to one skilled in the art that apparatus 10 may be quickly and unobtrusively slipped into position under tire 14. It will also be apparent to one skilled in the art that apparatus 10 flattens the tires of the suspects vehicle before he is even aware that he is under surveillance. The suspect can then be apprehended without endangering the public in a high speed chase. It will finally be apparent to one skilled in the art that modifications may be made to the illustrated embodiment without departing from the spirit and scope of the invention as hereinafter defined in the claims.

The embodiments of the invention in which an exclusive property or privilege is claimed are define as follows:

1. An apparatus for disabling a motor vehicle, comprising:

an elongate plinth-like base small enough to fit in the palm of a person's hand, the base having a first substantially planar surface, a second substantially planar surface, a first end and a second end;

at least one spike receiving aperture in the first planar surface, the at least one spike receiving aperture being positioned at the first end and oriented at an angle toward the second end of the base; and at least one hollow tubular spike removably secured in the at least one spike receiving aperture, the spike protruding from the first planar surface;

the at least one spike receiving aperture being only at the first end of the base, such that a vehicular tire mounts unimpeded onto the base from the second end with the base being held securely in position by the vehicular tire as it engages the at least one spike at the first end.

2. The apparatus for disabling a motor vehicle, as defined in claim 1, wherein the spike protrudes at an angle of between 75 and 85 degrees.

3. The apparatus for disabling a motor vehicle as defined in claim 1, wherein the base is of a flexible material.

4. The apparatus for disabling a motor vehicle as defined in claim 3, wherein means is provided to prevent the at least one spike from being pushed through the second planar surface of the rubber base.

5. The apparatus for disabling a motor vehicle as defined in claim 4, wherein metal shielding on the second planar surface serves as means to prevent the at least one spike from being pushed through the second planar surface of the base.

6. The apparatus for disabling a motor vehicle as defined in claim 1, wherein the plinth-like base has a peripheral edge, and at least one secondary spike receiving aperture is provided along the peripheral edge for storage of the at least one spike.

7. The apparatus for disabling a motor vehicle as defined in claim 1, wherein the plinth-like base and the at least one spike are camouflaged thereby reducing the possibility of detection.

8. An apparatus for disabling a motor vehicle, comprising:

a plinth-like rubber base small enough to fit in the palm of a person's hand, the base having a first substantially planar surface, a second substantially planar surface, a first end, a second end and a peripheral edge;

two primary spike receiving apertures in the first planar surface of the base, the spike receiving apertures being positioned at the first end and oriented toward the second end of the base at an angle of 75 to 85 degrees relative to the first planar surface;

two hollow tubular spikes removably insertable into the spike receiving apertures, such that the spikes protrude from the first planar surface at an angle of between 75 and 85 degrees;

metal shielding along the second planar surface, thereby preventing the spikes from being pushed through the rubber base;

secondary spike receiving apertures along the peripheral edge of the base, the secondary spike receiving apertures providing a place for storage of the spikes when they are removed from the primary spike receiving apertures; and the plinth-like base, the metal shielding and the spikes being covered by a black coating, thereby camouflaging them so they are less visible adjacent a black tire; and the primary spike receiving apertures being only at the first end of the base, such that a vehicular tire mounts unimpeded onto the base from the second end with the base being held securely in position by the vehicular tire as it engages the spikes at the first end.

9. An apparatus for disabling a motor vehicle, comprising:

a plinth-like base small enough to fit in the palm of a person's hand, the base having a first substantially planar surface, a second substantially planar surface, a first end, a second end and a peripheral edge;

two primary spike receiving apertures in the first planar surface of the base, the spike receiving apertures being positioned at the first end and oriented toward the second end of the base at an angle of 75 to 85 degrees relative to the first planar surface;

two hollow tubular spikes removably insertable into the spike receiving apertures, such that the spikes protrude from the first planar surface at an angle of between 75 and 85 degrees;

secondary spike receiving apertures along the peripheral edge of the base, the secondary spike receiving apertures providing a place for storage of the spikes when they are removed from the primary spike receiving apertures; and the primary spike receiving apertures being only at the first end of the base, such that a vehicular tire mounts unimpeded onto the base from the second end with the base being held securely in position by the vehicular tire as it engages the spikes at the first end.

* * * * *